US005873213A

United States Patent [19]

Draghetti

[11] Patent Number: 5,873,213

[45] Date of Patent: Feb. 23, 1999

[54] LINE FOR FEEDING STRIP MATERIAL TO A USER UNIT, PARTICULARLY A WRAPPING MACHINE

[75] Inventor: Fiorenzo Draghetti, Via San Donino, Italy

[73] Assignee: G.D Societa Per Azioni, Bologna, Italy

[21] Appl. No.: 611,882

[22] Filed: Mar. 6, 1996

[30] Foreign Application Priority Data

Mar. 10, 1995 [IT] Italy ..... BO95A0091

[51] Int. Cl.[6] ..... B65B 41/00

[52] U.S. Cl. ..... 53/389.2; 226/97; 226/118; 242/417.1; 53/551

[58] Field of Search ..... 53/550, 551, 589, 53/389.2; 226/97, 118; 242/417, 417.1

[56] References Cited

U.S. PATENT DOCUMENTS

| | | | |
|---|---|---|---|
| 2,796,223 | 6/1957 | Detweiler | 242/75.3 |
| 3,898,693 | 8/1975 | Chang | 360/73 |
| 3,967,319 | 6/1976 | McCollum | 360/90 |
| 4,093,148 | 6/1978 | Urynowicz | 242/182 |
| 4,210,682 | 7/1980 | Davis et al. | 226/118 |
| 4,316,568 | 2/1982 | Grant | 226/118 |
| 4,377,251 | 3/1983 | Kincheloe | 226/195 |
| 4,442,963 | 4/1984 | Grant | 226/97 |
| 4,714,212 | 12/1987 | Bosco et al. | 242/417.1 |
| 4,747,715 | 5/1988 | Lahr | 242/417.1 |
| 5,031,847 | 7/1991 | Tanaka | 242/417.3 |
| 5,501,412 | 3/1996 | McAleavey | 226/118 |

FOREIGN PATENT DOCUMENTS

| | | | |
|---|---|---|---|
| 1367396 | 9/1974 | United Kingdom | 242/417.1 |
| 2249782 | 5/1992 | United Kingdom . | |

*Primary Examiner*—John Sipos
*Assistant Examiner*—John Paradiso
*Attorney, Agent, or Firm*—Ladas & Parry

[57] ABSTRACT

A line for feeding a strip of wrapping material, whereby the strip is wound off an input reel and fed along a substantially U-shaped path to a traction unit via an adjusting unit for adjusting the tension of the strip; the adjusting unit is provided with a chamber in turn having a window located along the path of the strip. The chamber is tapered away from the window and the strip is subjected to a tension varying according to the length of strip drawn into the chamber.

9 Claims, 5 Drawing Sheets

1
2
3
4
5
6
7
8
9
10
11
12
13
14
15
16
17
17a
18
19
20
21
22
23
24
25
25a
26
27
28
29
30
31
33
40
41
47
50a
P 30
32
33
35
36
37
38
39
40
41
42
43
44
45
46
47
48
49
50
50a
A
P
11
27

LINE FOR FEEDING STRIP MATERIAL TO A USER UNIT, PARTICULARLY A WRAPPING MACHINE

BACKGROUND OF THE INVENTION

The present invention relates to a line for feeding strip material to a user unit, particularly a wrapping machine.

In the following description, it is assumed, purely by way of example, that the wrapping machine is of the type commonly known as "form, fill and seal."

At present, known lines for supplying a strip of wrapping material comprise a guide device defining a given path for the strip; a traction device at the output end of the path, for imparting a given traveling speed to the strip; and a tensioning device for controlling and adjusting the tension of the strip.

U.S. Pat. No. 2,710,154 relates to a pneumatic tensioning device located upstream from the traction device, and which provides for compensating any variation in the tension of the strip and so maintaining a given tension.

The above known pneumatic tensioning device comprises a cup-shaped body connected to a suction source, and presenting an open end—hereinafter referred to as a "window"—located along and defining a portion of the path along which the strip travels.

In actual use, the strip travels in airtight manner past the window, and is subjected to a substantially constant tension equal to the vacuum inside the cup-shaped body, so that a reduction in the tension applied to the strip by the traction device is immediately compensated by the formation, inside the cup-shaped body, of a loop, which gets shorter as the tension applied to the strip by the traction device is increased.

By applying a substantially constant tension to the strip, the above tensioning device is of advantage for adjusting strip tension on machines in which the strip is fed at substantially constant speed and is only rarely subjected to transient speeds and, hence, transient tensions. In fact, by applying a substantially constant tension to the strip, the above device opposes any acceleration of the strip, and acts as a brake, which, in addition to reducing transient speeds, also results in instantaneous over-tensioning and possible tearing of the strip.

As such, the above known pneumatic tensioning device is far from suitable for use on packing machines, the output speed of which is affected by numerous factors and therefore normally variable.

SUMMARY OF THE INVENTION

It is an object of the present invention to provide a feed line featuring a pneumatic tensioning device designed to safely permit frequent variations in output speed.

According to the present invention, there is provided a line for feeding a strip to a user unit, particularly a wrapping machine; the line comprising a strip traction unit defining one end of the line; guide means defining a given path along which the strip is fed to the traction unit; and adjusting means for adjusting the tension of the strip along said path; said adjusting means comprising a chamber with a window defining a portion of said path, and vacuum means connected to, and for forming an adjustable vacuum inside, the chamber; characterized in that the chamber is tapered as of said window, and is defined by two walls forming a substantially acute angle.

According to a preferred embodiment of the above line, said path is substantially U-shaped, and the chamber is located at a concave portion of the path.

The chamber preferably presents adjusting means for adjusting the size of said window in relation to said path.

BRIEF DESCRIPTION OF THE DRAWINGS

Two non-limiting embodiments of the present invention will be described by way of example with reference to the accompanying drawings, in which.

DETAILED DESCRIPTION OF THE INVENTION

Figure 1:
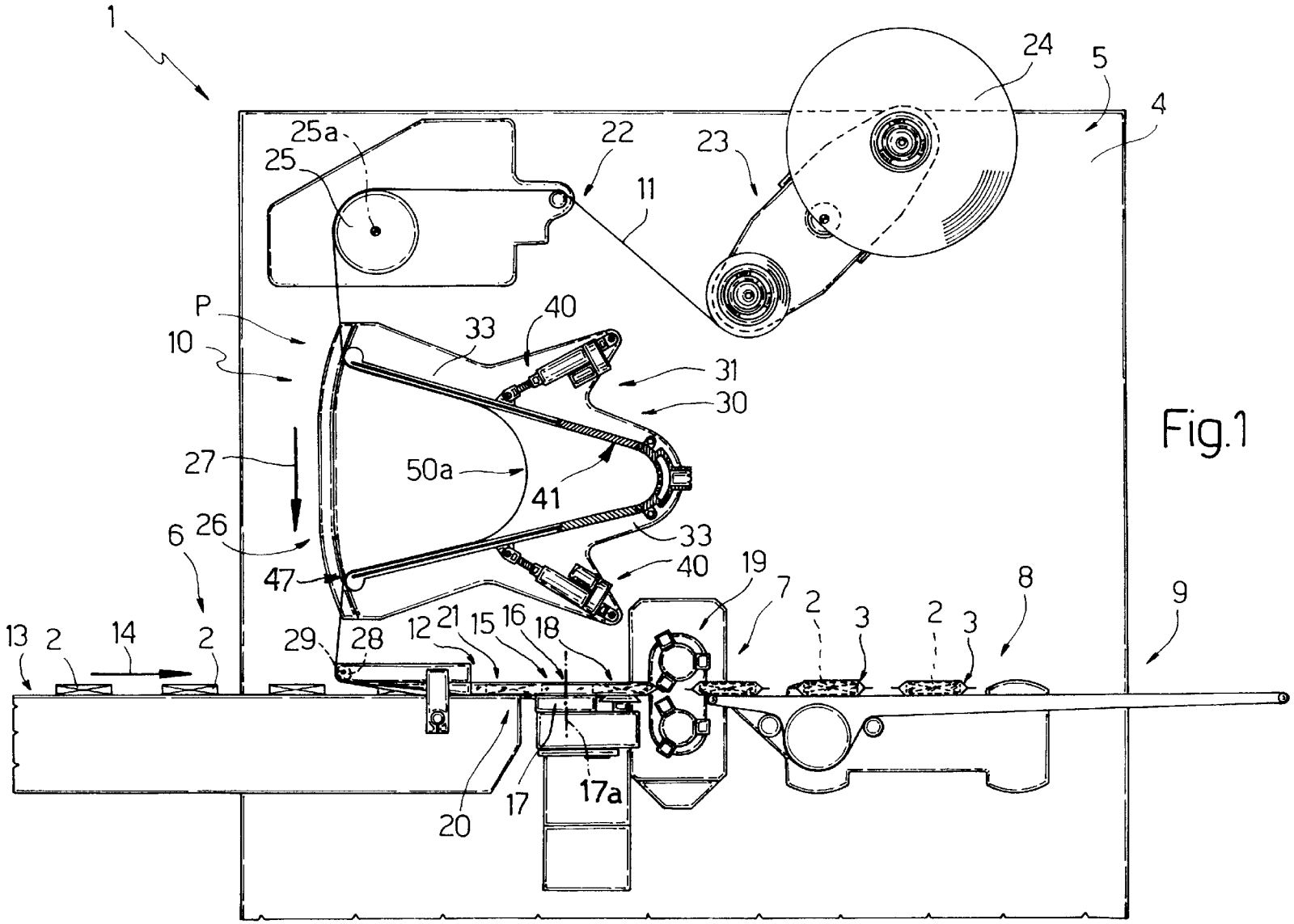
FIG. 1 shows a schematic side view, with parts in section and parts removed for clarity, of a first embodiment of the line according to the present invention.

Numeral 1 in FIG. 1 designates a wrapping machine for enclosing products 2 inside respective wrappings 3.

Machine 1 comprises a supporting frame 4 presenting a vertical front surface 5, and supporting a known product input device 6, a known product wrapping device 7, and a known output conveyor 8 for receiving the wrapped products 2 from device 7 and feeding them to the output station 9 of machine 1. Machine 1 also comprises a feed line 10 supported by frame 4 over at least part of devices 6 and 7, and which provides for feeding a continuous strip 11 of wrapping material to the input 12 of device 7 and through device 7 itself.

Input device 6 comprises a known, substantially horizontal conveyor 13 for supplying input 12 of device 7 with an orderly succession of products 2 in a direction 14 parallel to conveyor 13.

Wrapping device 7 is supplied simultaneously with products 2 and strip 11, and comprises a known wrapping beam 15 located at input 12, for folding strip 11 in a U over and about products 2; and a known traction unit 16 located downstream from beam 15 and forming the output element of line 10. Traction unit 16 comprises two rollers 17 (only one is shown) rotating about respective axes 17*a*, and which provide for both pulling strip 11 to impart a given tension, and for joining the lateral edges of strip 11 beneath products 2 to form a continuous tubular wrapping 18. Finally, device 7 also comprises a known sealing and cutting unit 19 for receiving wrapping 18 from unit 16 and cutting it in known manner into a succession of wrapped products 2, which are then fed to conveyor 8 and by this to output station 9 in a direction parallel to direction 14.

Line 10 defines, for strip 11, a substantially U-shaped path P comprising an output arm 20 extending in direction 14 and defined by the output portion 21 of conveyor 13 and by wrapping device 7; and an input arm 22 extending, parallel to direction 14 and above arm 20, from a known device 23 for unwinding reels 24 of strip 11. At a guide roller 25 fitted to frame 4 and rotating about an axis 25*a* perpendicular to surface 5 of frame 4, arm 22 is connected to an intermediate arm 26 extending, in a direction 27 substantially perpendicular to direction 14, from roller 25 to a guide roller 28 connecting arm 26 to arm 20, and which is located beneath roller 25 and above conveyor 13, and rotates about an axis 29 parallel to axis 25*a*.

Line 10 also comprises a pneumatic adjusting unit 30 located along arm 26 between arms 20 and 22, i.e. inside a space 31 substantially bordered by path P, and which provides for adjusting the tension of strip 11 when strip 11 is subjected to traction by unit 16, and regardless of whether unit 16 is operated at constant or variable speed.

Figures 2, 2A:
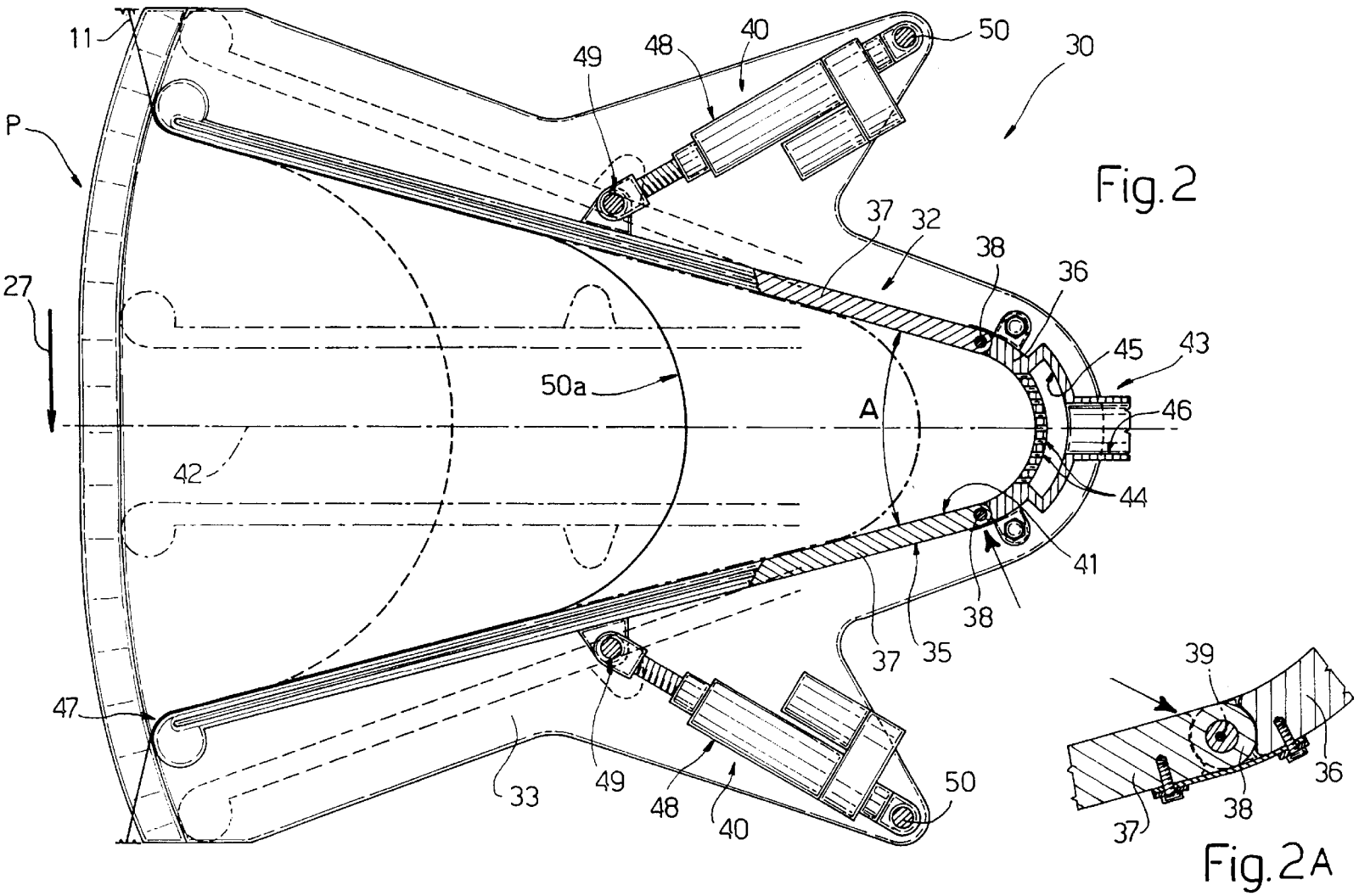
FIG. 2 shows a larger-scale detail of FIG. 1.
Figure 3:
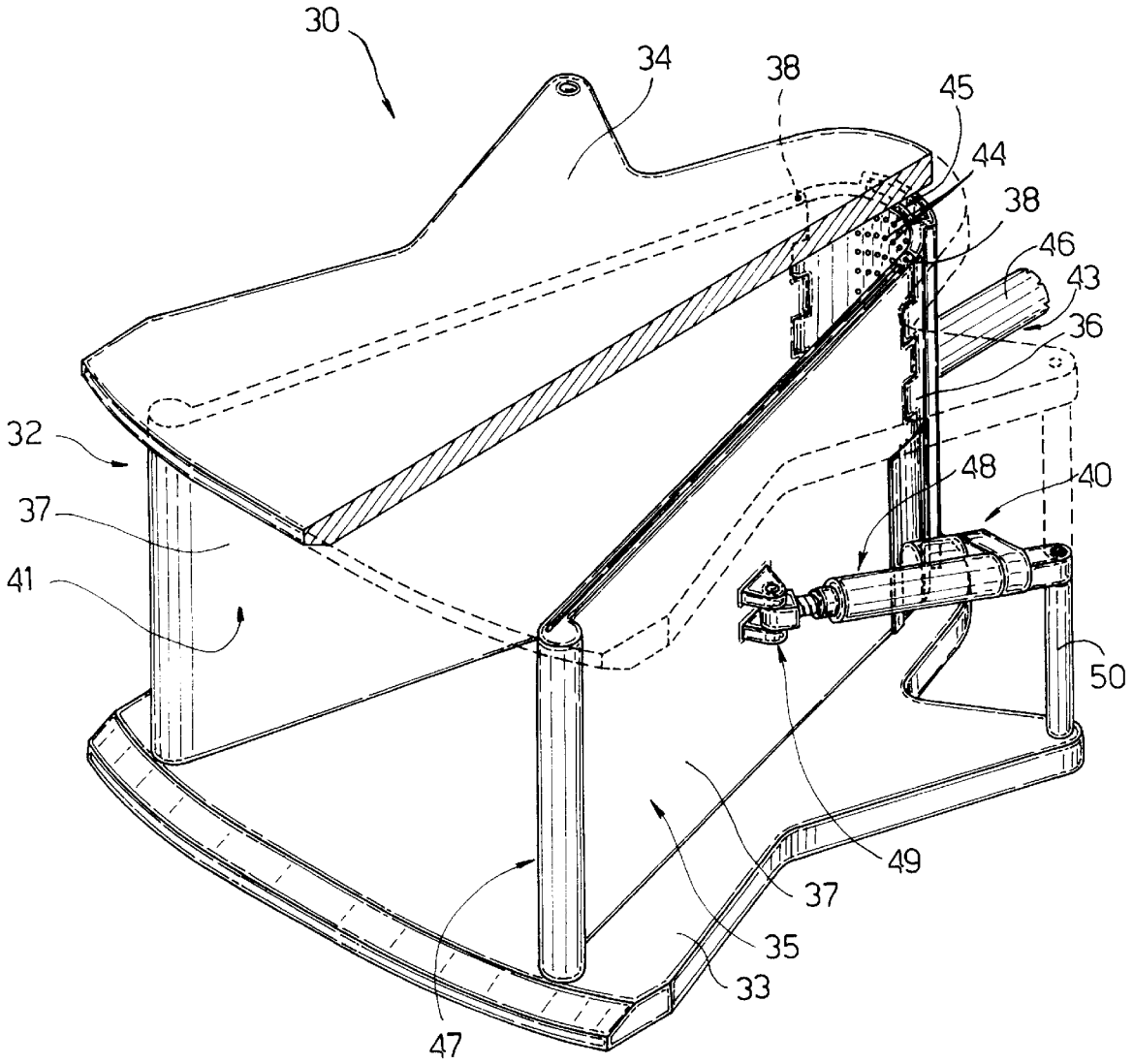
FIG. 3 shows a schematic view in perspective of the FIG. 2 detail.

As shown in FIGS. 2 and 3, unit 30 comprises a casing 32 integral with surface 5 of frame 4, and in turn comprising two lateral walls 33, 34 perpendicular to axis 29 and parallel to surface 5, and of which wall 33 is located facing surface 5. Casing 32 also comprises a wall 35 located between and crosswise to walls 33, 34, and having a substantially U-shaped central portion 36 perpendicular to surface 5 and with its concavity facing path P. Wall 35 also has two flat end portions 37 facing each other, perpendicular to surface 5 and walls 33, 34, and defining a substantially acute angle A therebetween. Portions 37 are hinged to respective free ends of central portion 36 by respective hinges 38 with respective axes 39 parallel to each other and to axis 29, extend towards path P from central portion 36, and are swung about respective axes 39 by respective adjusting devices 40.

Walls 33, 34, 35 define a chamber 41 presenting an intermediate plane of symmetry 42 crosswise to surface 5, and connected to a known suction device 43, the outlet end of which is defined by a number of holes 44 formed through central portion 36. Holes 44 connect chamber 41 to a further chamber 45 located outside wall 35, defined by central portion 36, and having an inlet conduit 46 connected in known manner to a known vacuum device (not shown) forming part of device 43. Chamber 41 also has a window 47 crosswise to plane 42 along a portion of path P.

Each device 40 provides for moving respective portion 37 to and from the other portion 37 to adjust the size of both chamber 41 and window 47 parallel to path P, and comprises a powered screw-nut screw pair 48, the screw of which is connected at its free end to a further hinge 49 integral with respective portion 37, and the nut screw of which is fitted to a respective rod 50 fitted between walls 33 and 34 and parallel to axes 39.

In actual use, strip 11 is subjected to traction by unit 16, which feeds it along line 10 and through input 12 of wrapping device 7 simultaneously with products 2, which in turn are fed to input 12 by conveyor 13 of device 6, and are wrapped inside strip 11 to form continuous wrapping 18 and subsequently wrappings 3.

To ensure the products are wrapped properly along beam 15, the tension of strip 11 is adjusted by unit 30. For which purpose, strip 11, as it travels past window 47, is drawn inside chamber 41 by suction device 43, and is guided inside chamber 41 on portions 37 to form a loop 50*a* with its concavity facing window 47.

By means of devices 40, the size of both chamber 41 and window 47 may be adjusted to adjust the tension of strip 11 along path P, and to adjust the take-up of any slack along strip 11 caused by traction unit 16 slowing down, while suction device 43 provides for creating, inside chamber 41, an adjustable hydrostatic vacuum distributed substantially evenly over the width of strip 11 to vary the tension of the strip.

Unlike former adjusting devices, which adjusted the tension of strip 11 by simply adjusting the vacuum inside chamber 41 by means of suction devices similar to device 43, unit 30 also provides for adjusting the tension of strip 11 by adjusting the position of loop 50*a* inside chamber 41, i.e. by applying a vacuum to a surface of strip 11 varying in length according to the position of loop 50*a*. For a given suction condition, as loop 50*a* is drawn more deeply inside chamber 41, the tension of strip 11 gradually decreases, thus providing not only for resetting loop 50*a* more easily to a given position, but also for enabling troublefree take-up of strip 11 by unit 16.

Portions 37 of wall 35 are so positioned by respective adjusting devices 40 that chamber 41 tapers from window 47 to assume a substantially trapezoidal shape. As such, the free length of strip 11 not contacting portions 37, and which defines loop 50*a*, gets shorter and shorter towards central portion 36, so that, as stated, the surface of strip 11 subjected to suction and the tension of strip 11 are reduced accordingly.

Figure 4:
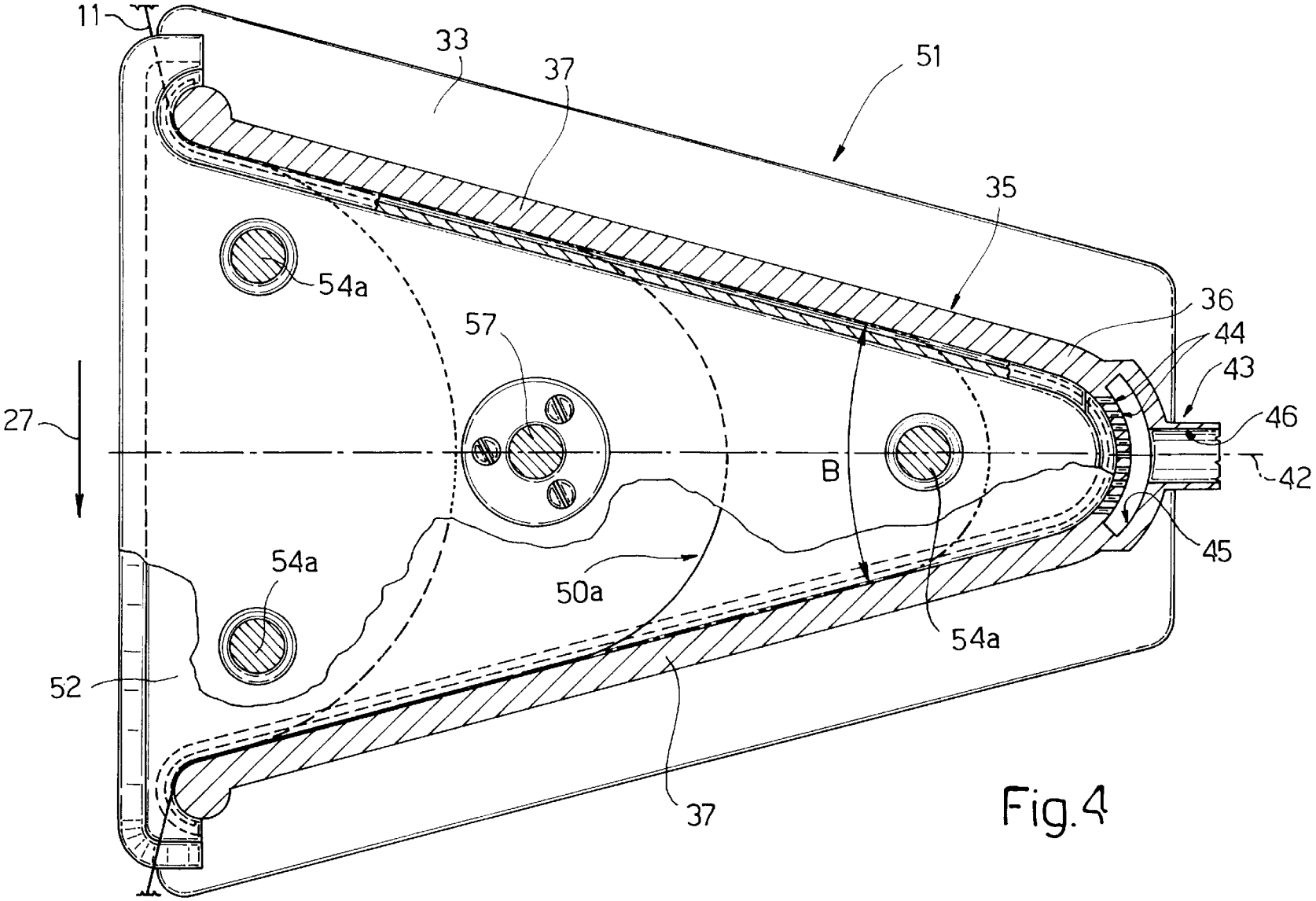
FIG. 4 shows a larger-scale view of a further embodiment of the FIG. 2 detail.
Figure 5:
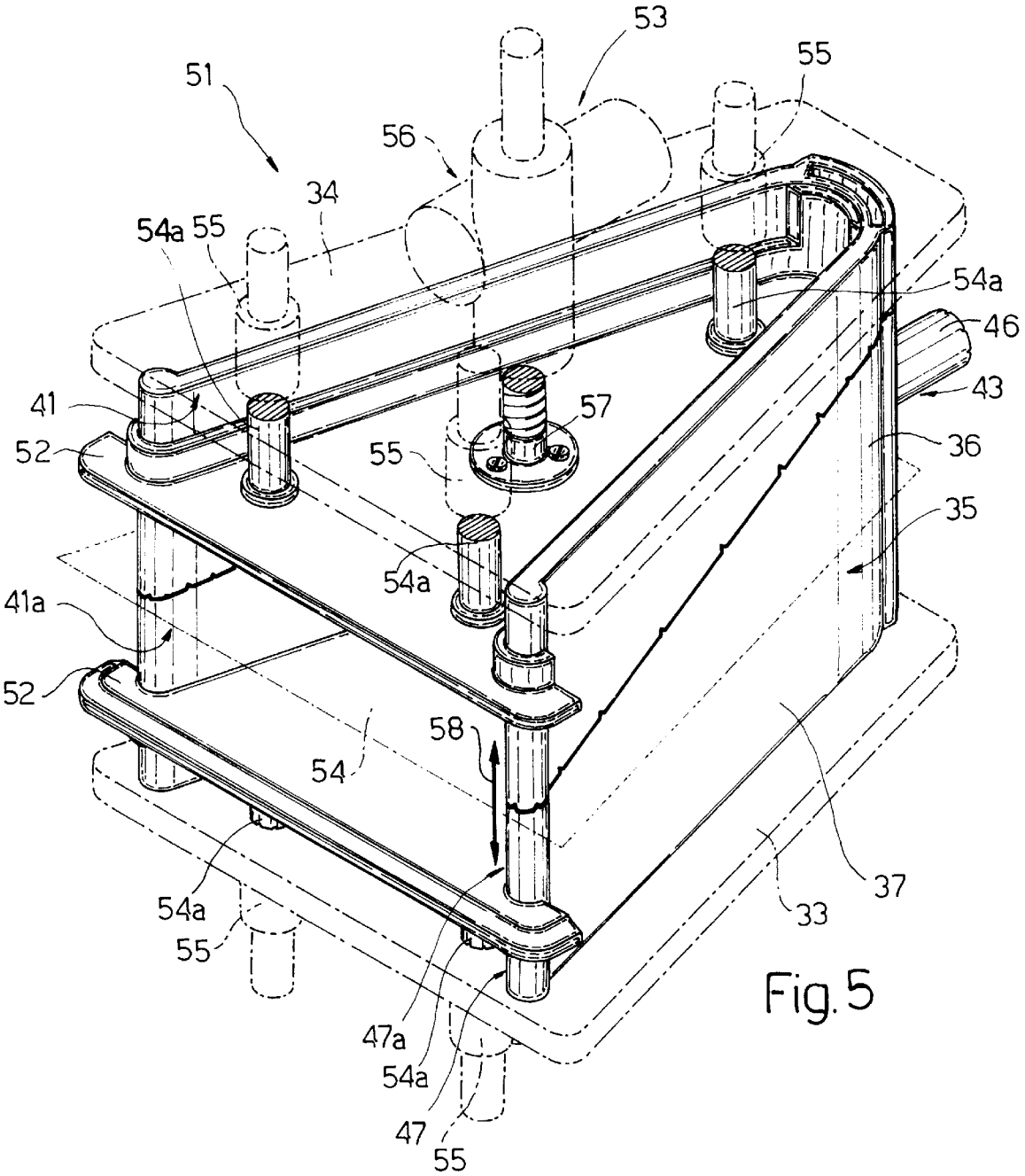
FIG. 5 shows a schematic view in perspective of the FIG. 4 detail.

The embodiment of FIGS. 4 and 5 embodiment relates to a unit 51 similar to unit 30, except that portions 37 of wall 35 are integral with portion 36, and form a given fixed, substantially acute angle B therebetween; and unit 51 comprises a pair of plates 52 located between and parallel to walls 33, 34, and which are connected in fluidtight manner to wall 35 with which they define a chamber 41*a* inside chamber 41, and are movable parallel to themselves—inside chamber 41 and by means of a further adjusting device 53—to and from a plane 54 of chamber 41, located crosswise to plane 42 and substantially halfway between walls 33 and 34. Chamber 41*a* in turn has a window 47*a* crosswise to plane 42 and along a portion of path P.

For each plate 52, adjusting device 53 comprises three guide rods 54*a* parallel to axis 29, having one end integral with respective plate 52, and fitted in sliding manner through respective bushes 55 fitted to respective wall 33, 34. Device 53 also comprises, for each plate 52, a known actuator 56 fitted to respective wall 33, 34 outside chamber 41, and presenting an output rod 57 fitted in sliding manner through respective wall 33, 34, and connected integrally at one end with respective plate 52 to move it parallel to itself and so adjust the size of both chamber 41*a* and window 47*a* in a direction 58 parallel to axis 29 and crosswise to path P.

Unit 51 operates in the same way as unit 30, except that the position of portions 37 of wall 35 is no longer adjustable. The size of window 47*a*, however, may be adjusted to also continuously align strip 11 in relation to wrapping beam 15, and eliminate any parallelism errors of the machine axes, and any defects in the geometry of reel 24 or the elastic characteristics of the material of strip 11.

In the event of a change in the size, i.e. width, of strip 11, the above tension and parallelism adjustments may still be made using unit 51, which, as stated, presents two adjusting devices 53 for adjusting the size of chamber 41*a* and window 47*a* in direction 58, and so ensuring sliding contact between the lateral edges of strip 11 and plates 52; which sliding contact is essential for ensuring alignment of the strip and the sealing required for maintaining a given vacuum inside chamber 41*a*.

A further point to note is that, when working with strips 11 gummed on one side, the substantially U shape of path P is especially advantageous by preventing any contact between the gummed surface and the guide rollers, in the event strip 11 is assembled with the gummed surface outwards.

What is claimed is:

1. A line for feeding a strip of wrapping material to a wrapping machine; the line comprising a strip traction unit defining one end of the line; guide means defining a given path along which the strip is fed to the traction unit; tension adjusting means for adjusting tension of the strip along said path; said tension adjusting means comprising a chamber with a window extending between two points along said path, and vacuum means connected to, and for forming an adjustable vacuum inside, the chamber; said guide means comprising two walls defining an inside surface of said chamber, said two walls forming said window and defining a substantially acute angle between one another such that said strip extends into said chamber along said two walls and forms a loop therebetween, said chamber including auxiliary adjusting means for adjusting the size of said window in a first direction parallel to said path.

2. A line as claimed in claim 1, wherein said path is substantially U-shaped; and the chamber forms a concavity in said path.

3. A line as claimed in claim 2, wherein said walls of said chamber are flat.

4. A line as claimed in claim 3, wherein the chamber includes further auxiliary adjusting means for adjusting the size of said window in a second direction perpendicular to said path.

5. A line for feeding a strip of wrapping material to a wrapping machine; the line comprising a strip traction unit defining one end of the line; guide means defining a given path along which the strip is fed to the traction unit; tension adjusting means for adjusting tension of the strip along said path; said tension adjusting means comprising a chamber with a window extending between two points along said path, and vacuum means connected to, and for forming an adjustable vacuum inside, the chamber; said guide means comprising two walls defining an inside surface of said chamber, said two walls forming said window and defining a substantially acute angle between one another such that said strip extends into said chamber along said two walls and forms a loop therebetween, said two walls being mounted for rotation about respective axes extending transversely with respect to said path; and auxiliary adjusting means coupled to said walls to rotate said walls about the respective said axes to vary said acute angle between the two walls.

6. A line as claimed in claim 1 wherein said two walls which form said acute angle therebetween have a narrow spacing at a first of the ends of the chamber and a wider spacing at a second of the ends of the chamber, said vacuum means being disposed at said first of the ends, said window being deposed at said second of the ends.

7. A line as claimed in claim 1 wherein said two walls extend from said window to taper at said acute angle in narrowing direction away from said window to cause said loop to become progressively smaller as the strip extends more deeply into the chamber.

8. A line for feeding a strip of wrapping material to a wrapping machine; the line comprising a strip traction unit defining one end of the line; guide means defining a given path along which the strip is fed to the traction unit; tension adjusting means for adjusting tension of the strip along said path; said tension adjusting means comprising a chamber with a window extending between two points along said path, and vacuum means connected to, and for forming an adjustable vacuum inside, the chamber; said guide means comprising two walls defining an inside surface of said chamber, said two walls forming said window and defining a substantially acute angle between one another such that said strip extends into said chamber along said two walls and forms a loop therebetween, said two walls extending from said window to taper at said acute angle in narrowing direction away from said window to cause said loop to become progressively smaller as the strip extends more deeply into the chamber, and means for varying the acute angle between said two walls.

9. A line for feeding a strip of wrapping material to a wrapping machine; the line comprising a strip traction unit defining one end of the line; guide means defining a given path along which the strip is fed to the traction unit; tension adjusting means for adjusting tension of the strip along said path; said tension adjusting means comprising a chamber with a window extending between two points along said path, and vacuum means connected to, and for forming an adjustable vacuum inside, the chamber; said guide means comprising two walls defining an inside surface of said chamber, said two walls forming said window and defining a substantially acute angle between one another such that said strip extends into said chamber along said two walls and forms a loop therebetween, said two walls extending from said window to taper at said acute angle in narrowing direction away from said window to cause said loop to become progressively smaller as the strip extends more deeply into the chamber, and means for adjusting volume of said chamber.

* * * * *